US009046325B1

(12) United States Patent
Littlestone et al.

(10) Patent No.: US 9,046,325 B1
(45) **Date of Patent: *Jun. 2, 2015**

(54) EXPLOSIVE BLAST FREQUENCY CONTROL SHIELD AND METHOD

(71) Applicant: The United States of America as represented by the Secretary of the Navy, Washington, DC (US)

(72) Inventors: Alyssa A. Littlestone, Washington, DC (US); Philip J. Dudt, North Bethesda, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/974,115

(22) Filed: Aug. 23, 2013

Related U.S. Application Data

(63) Continuation-in-part of application No. 13/779,973, filed on Feb. 28, 2013.

(60) Provisional application No. 61/723,896, filed on Nov. 8, 2012.

(51) Int. Cl.
*F41H 5/007* (2006.01)
*F41H 5/04* (2006.01)

(52) U.S. Cl.
CPC ..... *F41H 5/0471* (2013.01)

(58) Field of Classification Search
CPC ..... F41H 1/02; F41H 5/023; F41H 5/04; F41H 5/0414; F41H 5/013; F41H 5/0421; F41H 5/0442; F41H 5/0492; F42D 5/05; F42D 5/045; E04H 9/04
USPC ..... 52/202, 782.1, 783.1; 89/36.01, 36.02, 89/904, 910, 914, 917, 930; 73/35.14; 156/60
See application file for complete search history.

(56) References Cited

U.S. PATENT DOCUMENTS

| | | | | |
|---|---|---|---|---|
| 1,344,722 | A | 6/1921 | Schulz | |
| 3,684,631 | A * | 8/1972 | Dunbar | 428/46 |
| 5,007,326 | A * | 4/1991 | Gooch et al. | 89/36.02 |
| 5,593,736 | A * | 1/1997 | Cowen et al. | 427/492 |
| 7,938,053 | B1 | 5/2011 | Dudt et al. | |
| 8,001,880 | B2 | 8/2011 | White et al. | |
| 2005/0217471 | A1* | 10/2005 | Benitsch | 89/36.02 |
| 2011/0005695 | A1* | 1/2011 | Boone et al. | 160/377 |

OTHER PUBLICATIONS

J.S. Davidson et al., Failure Mechanisms of Polymer-Reinforced Concrete Masonry Walls Subjected to Blast, Journal of Structural Engineering (Aug. 2005), pp. 1194-1205.

(Continued)

*Primary Examiner* — Jeanette E Chapman
(74) *Attorney, Agent, or Firm* — Richard A. Morgan

(57) ABSTRACT

A composite shield comprises a panel including an outer ballistic fabric strike surface layer and an inner structural armor plate layer. The structural armor plate layer has a multiplicity of traversing ports. The traversing ports have sufficient lateral area to allow deformation of the ballistic fabric through the structural armor plate layer on the occurrence of explosive blast. The composite shield is particularly effective in protecting personnel. Blast frequencies in the damaging 1000 to 3000 Hz range are attenuated.

16 Claims, 13 Drawing Sheets

(56) References Cited

OTHER PUBLICATIONS

R.H. Cole, Diaphragm Gauges, Underwater Explosions, Princeton University Press, Princeton, N.J. (1948), pp. 157-159.
G.S. Langdon et al., Perforated Plates as Passive Mitigation Systems, Defense Science Journal, vol. 58, No. 2, Mar. 2008, pp. 238-247.
A. Britan et al., Experimental and Numerical Study of Shock Wave Interaction With Perforated Plates, Journal of Fluids Engineering, vol. 126, May 2004, pp. 399-409.
G.J. Cooper, Protection of the Lung from Blast Overpressure by Thoracic Stress Wave Decouplers, Journal of Trauma: Injury, Infection and Critical Care, vol. 40, No. 3, (Mar. Supplement 1996), S105-S110.
Y. Andreopoulos et al., Moving shocks through metal grids: their interaction and potential for blast wave mitigation, Shock Waves (2007) vol. 16, pp. 455-466.
A.A. Littlestone et al., Blast Frequency Control for Personnel Survivability, NSWCCD, West Bethesda, MD, Technical Report NSWCCD-66-TR-2012/20 (Aug. 2012).
A.A. Littlestone et al., Coupling Perforated Plate with Ballistic Fiber Plies to Control Transmitted Blast Pressure and Critical Frequency, NSWCCD, West Bethesda, MD, Technical Report NSWCCD-66-TR-2012/37 (Dec. 2012).
Department of Defense Test Method Standard, V50 Ballistic Test for Armor, MIL-STD-662F, Dec. 18, 1997.
Y.Y. Phillips et al., Cloth Ballistic Vest Alters Responce to Blast, The Journal of Trauma, vol. 28, No. 1 Suppl., Jan. 1988,S149-S152.
P.W. Gibson, Amplification of Air Shock Waves by Textile Materials, J. Textile Institute, 1995, 86, No. 1., pp. 119-128.
W.D. Freeston, Jr., et al. Strain-Wave Reflections During Ballistic Impact of Fabric Panels, Textile Research Journal, vol. 43, No. 6, Jun. 1973, pp. 348-351.

* cited by examiner 2
38a 40
42
46
48
34a
34b
38c
32a
32b
30
G
2
3
38a
46
55

40
55 D
38d
38b
55
55 D
55
30
46
38c
G
3 n= # of holes with radius r
N = # of holes with radius R
I= distance between centers
r = smaller radius
R= larger port radius n = # of holes with radius r
I = distance between radius r centers 16-Hole Design 16x25 Hole Design 64-Hole Design 64x49 Hole Design 225-Hole Design

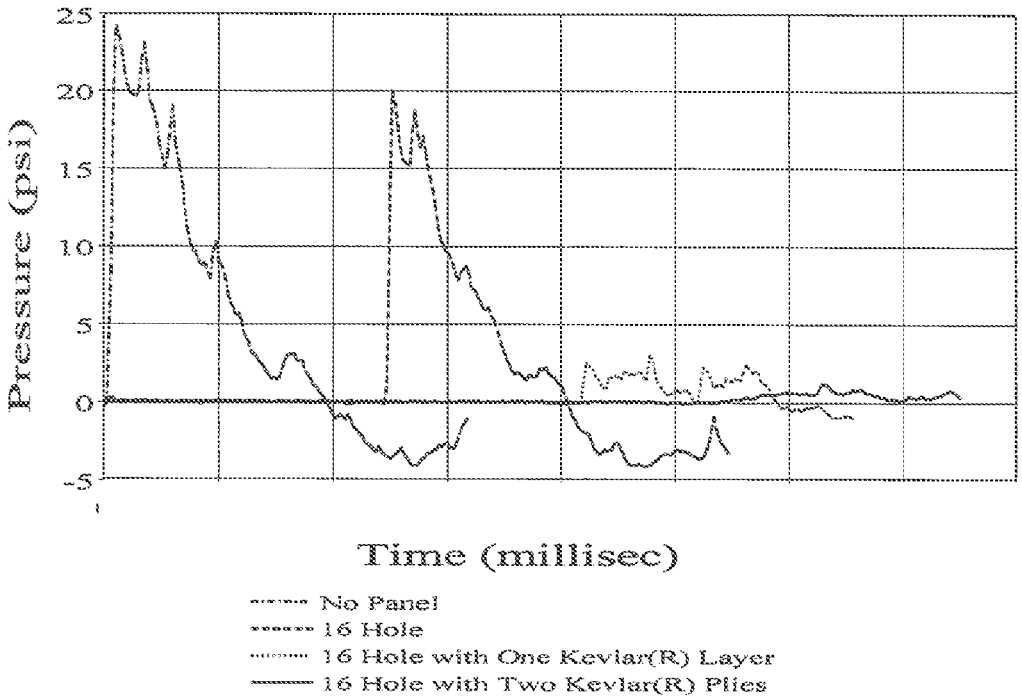
Figure 5a. Transmitted Pressure
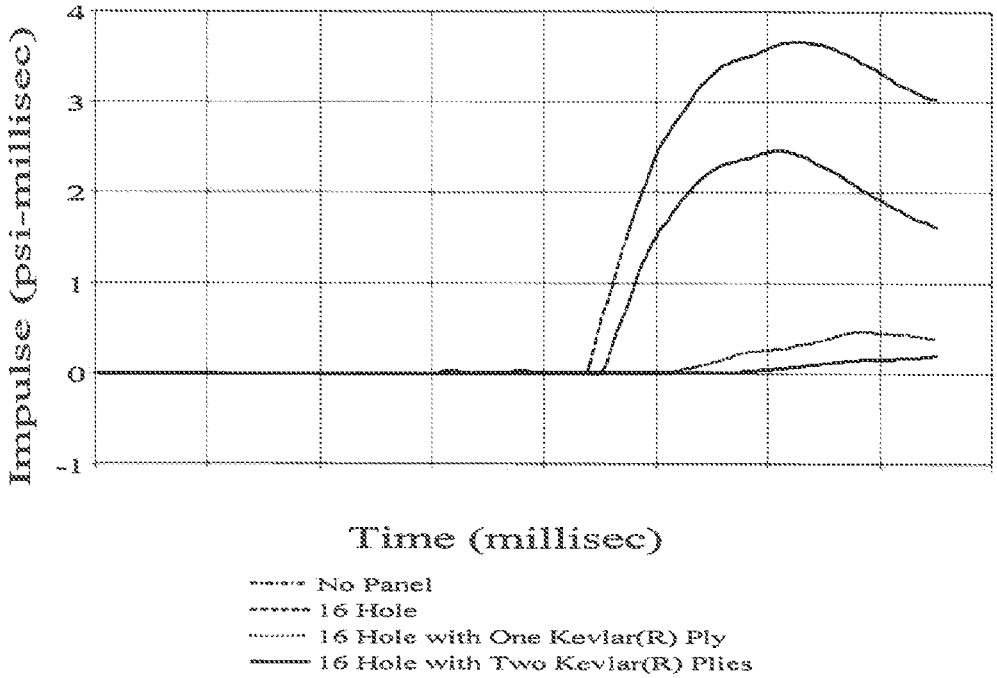
Figure 5b. Transmitted Impulse

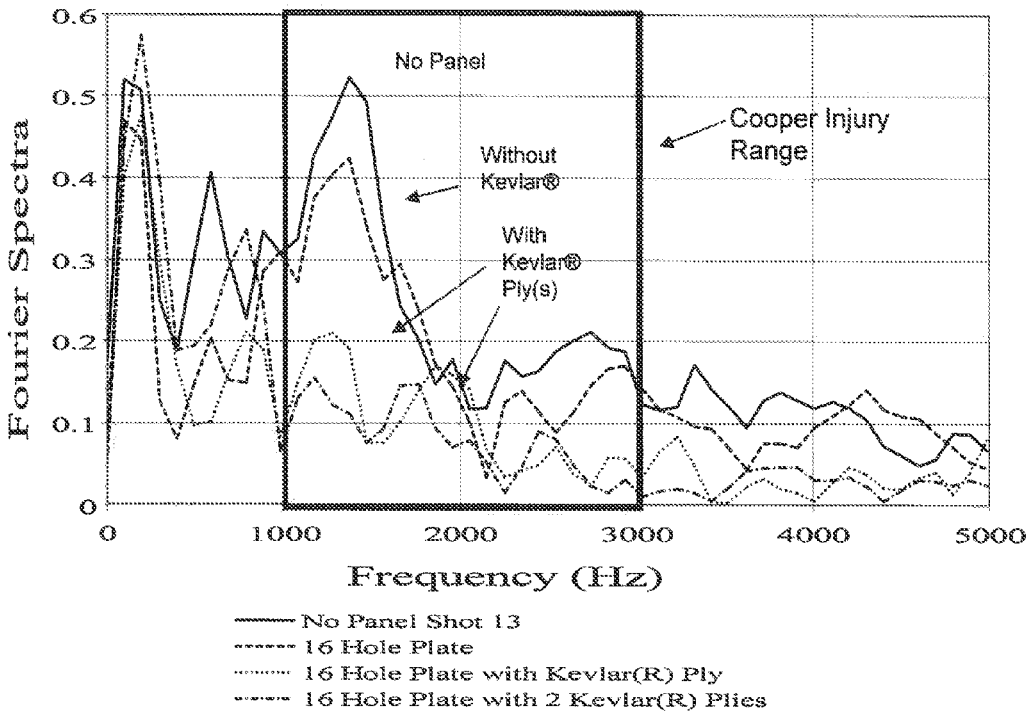
Figure 5c. Fourier Spectra

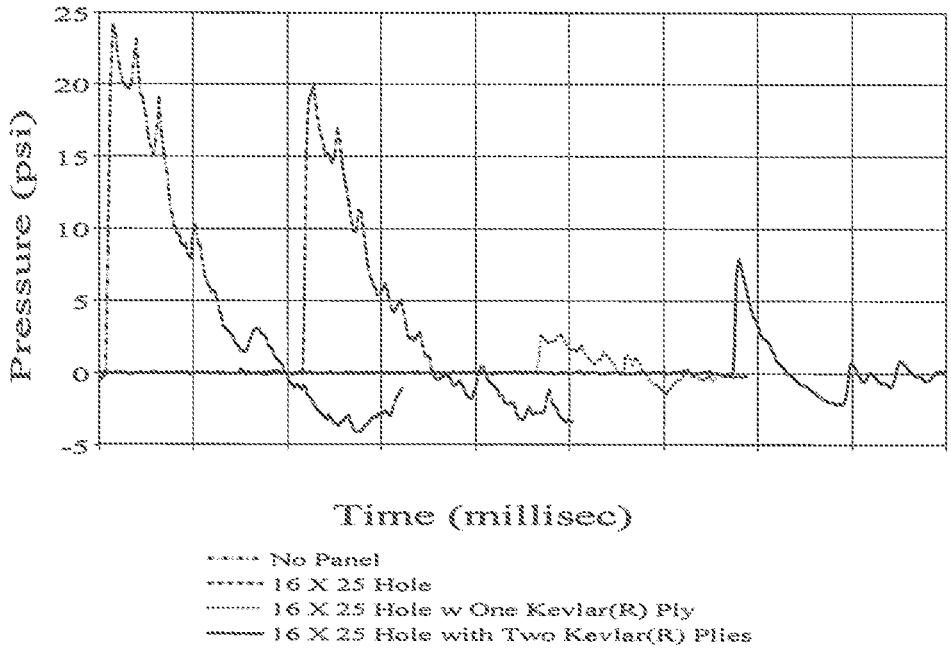
Figure 6a. Transmitted Pressure
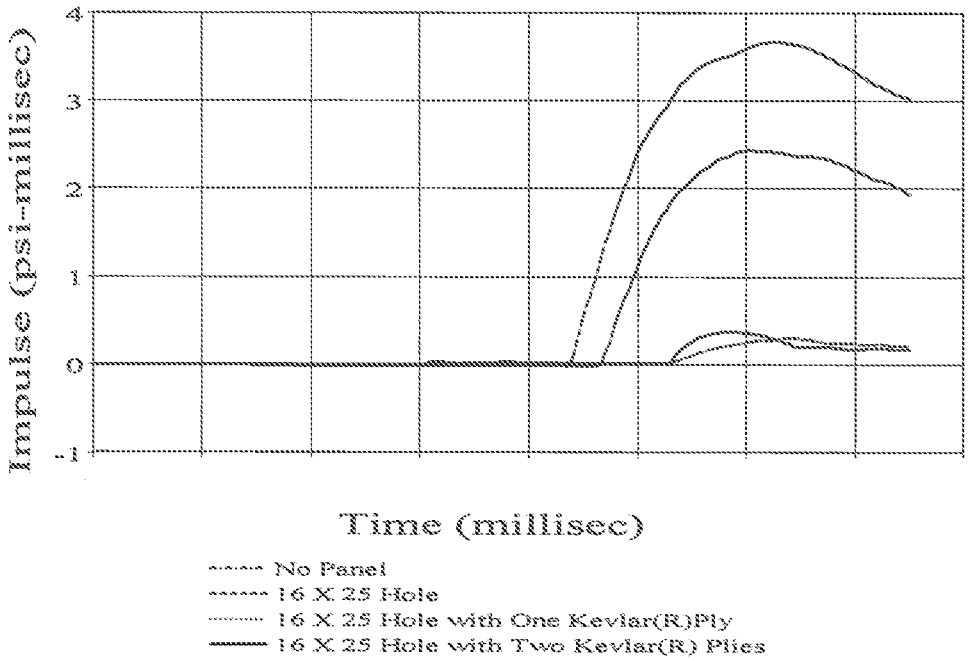
Figure 6b. Transmitted Impulse

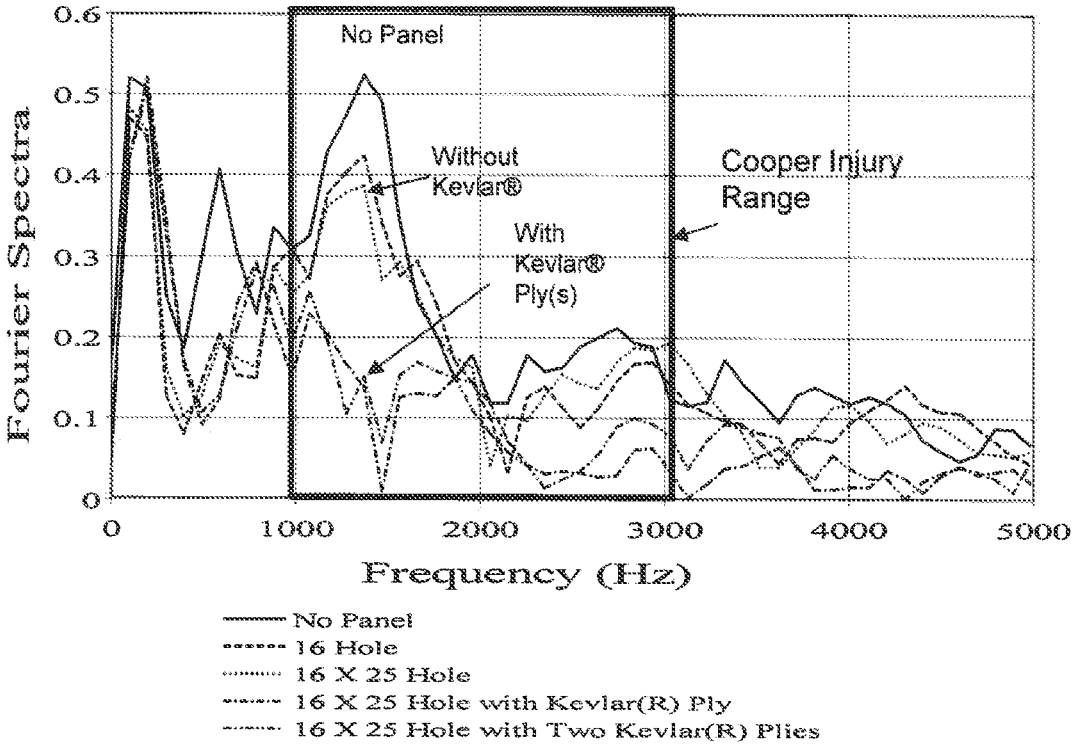
Figure 6c. Fourier Spectra

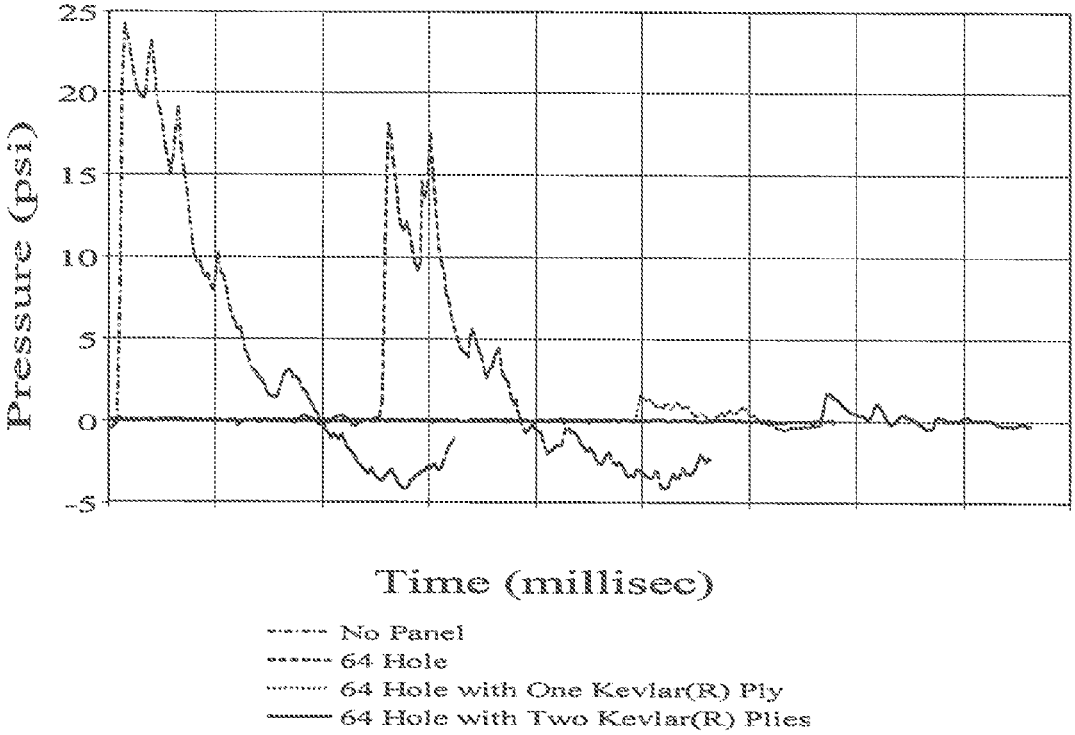
Figure 7a. Transmitted Pressure
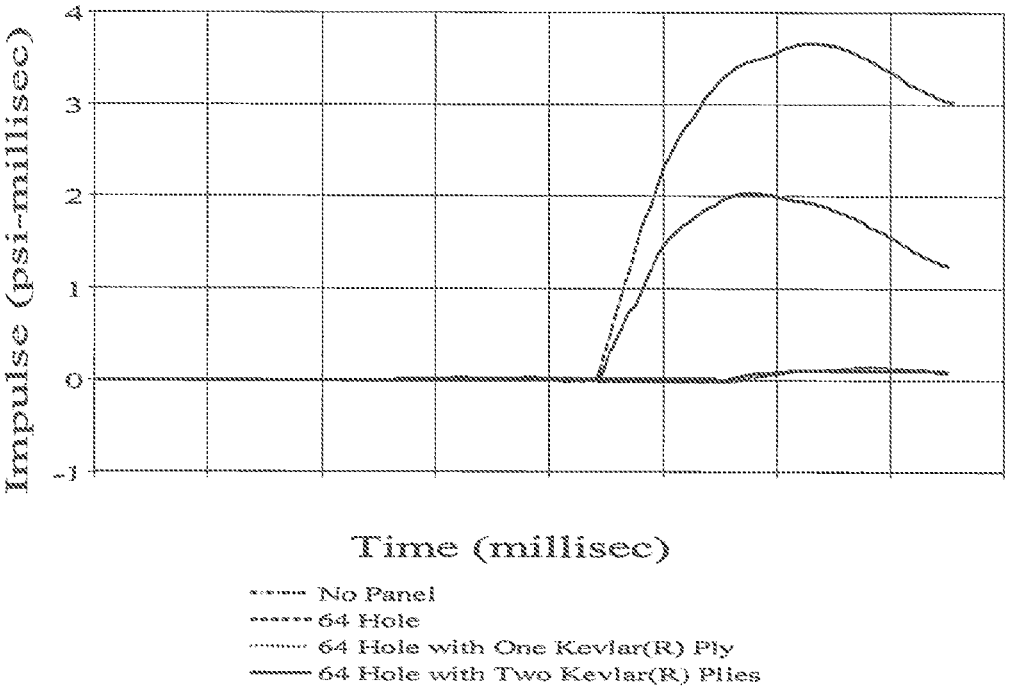
Figure 7b. Transmitted Impulse

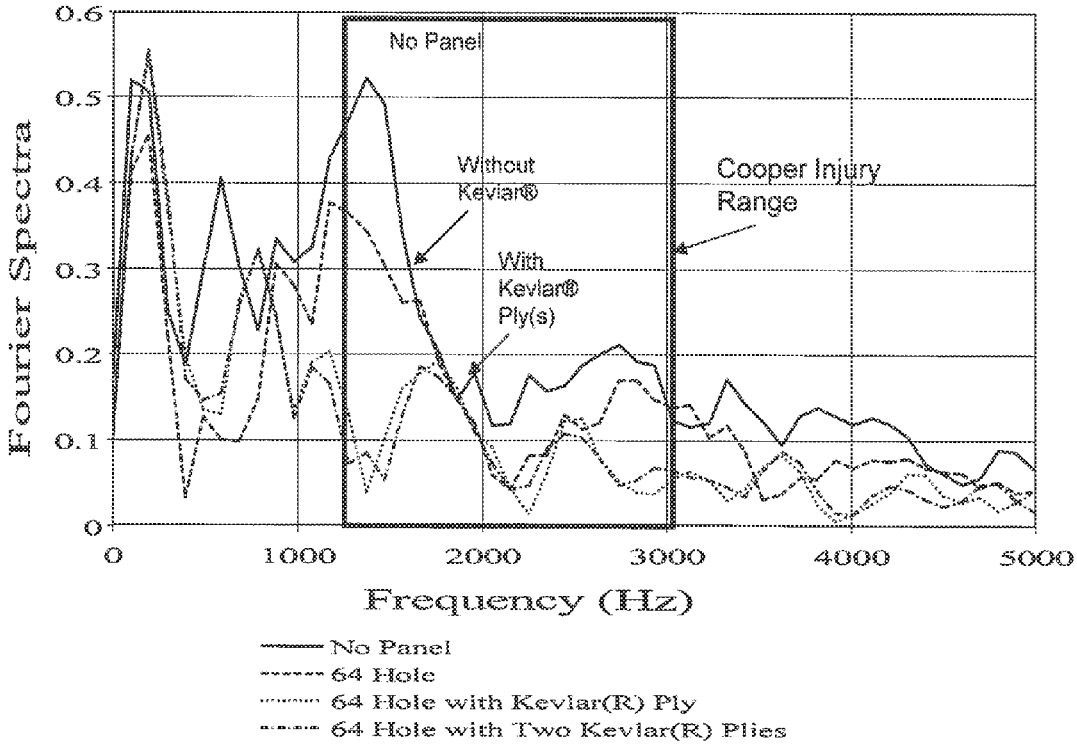
Figure 7c. Fourier Spectra

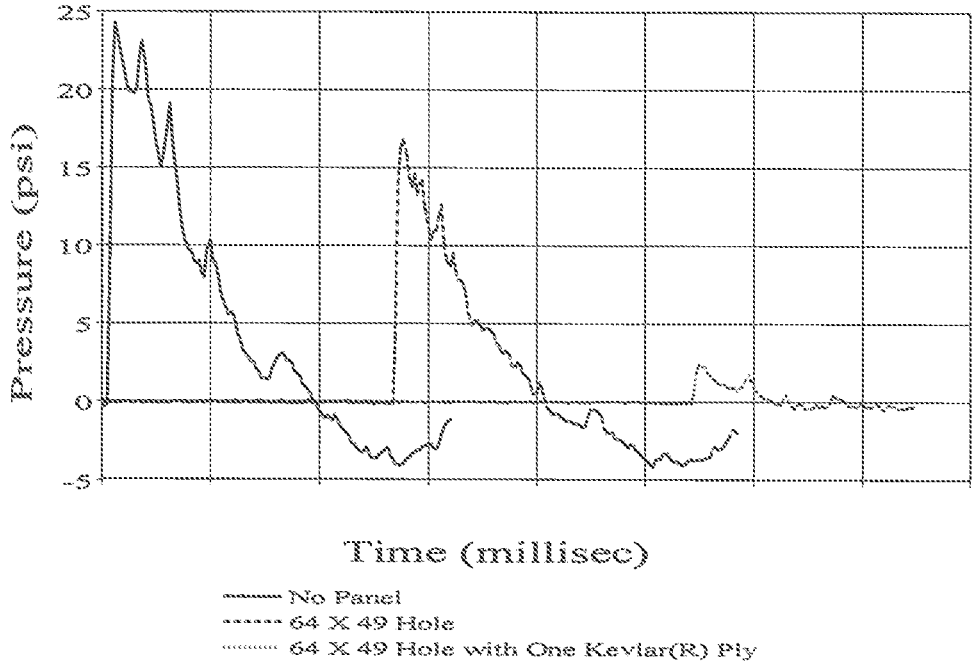
Figure 8a. Transmitted Pressure
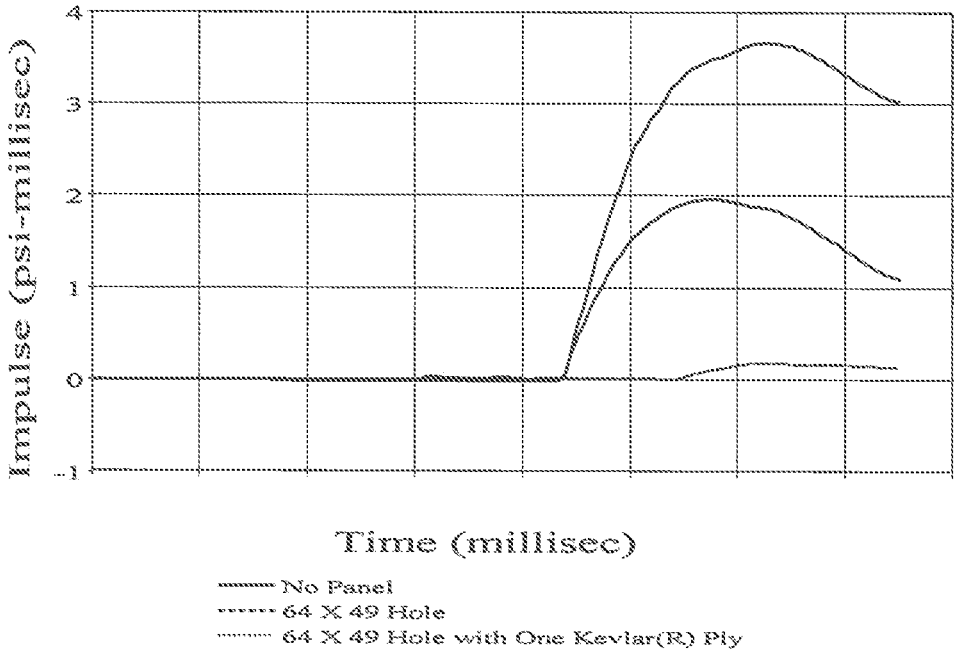
Figure 8b. Transmitted Impulse

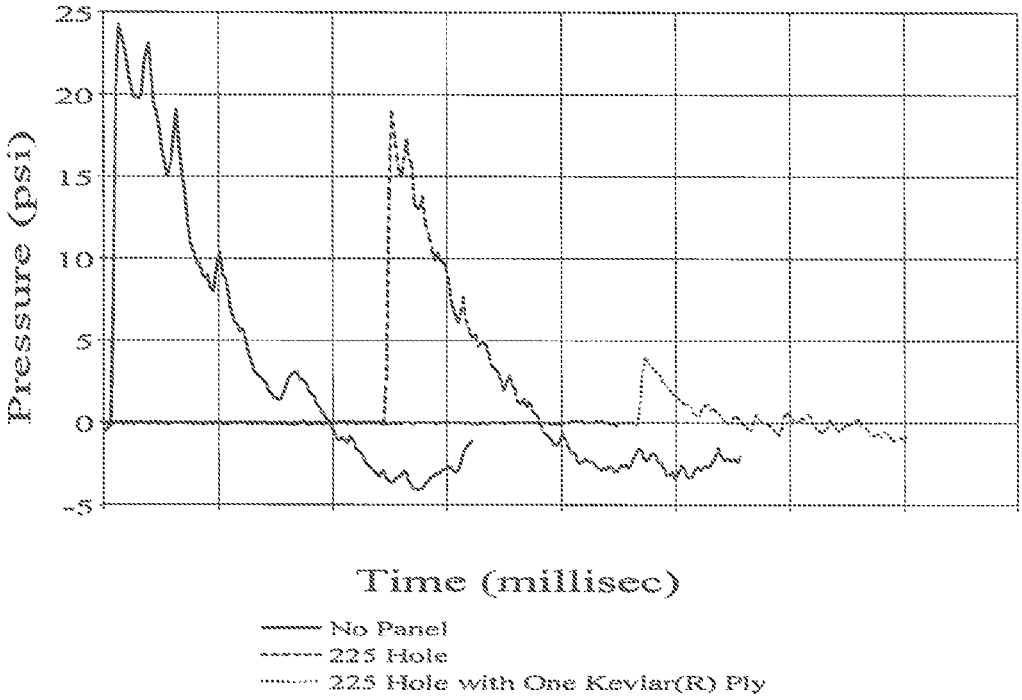
Figure 9a. Transmitted Pressure
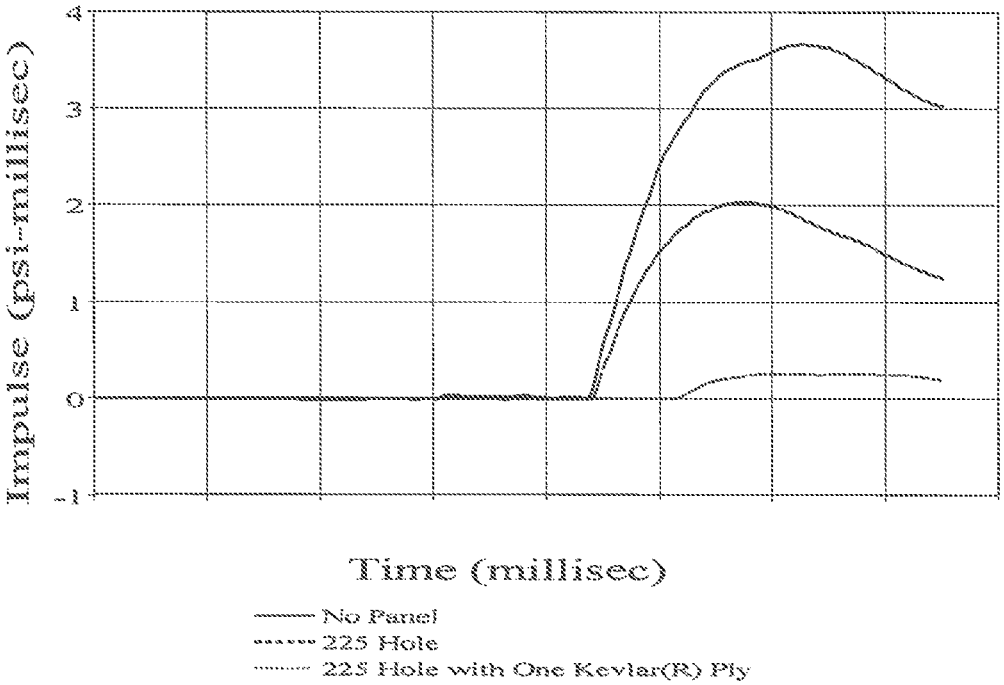
Figure 9b. Transmitted Impulse

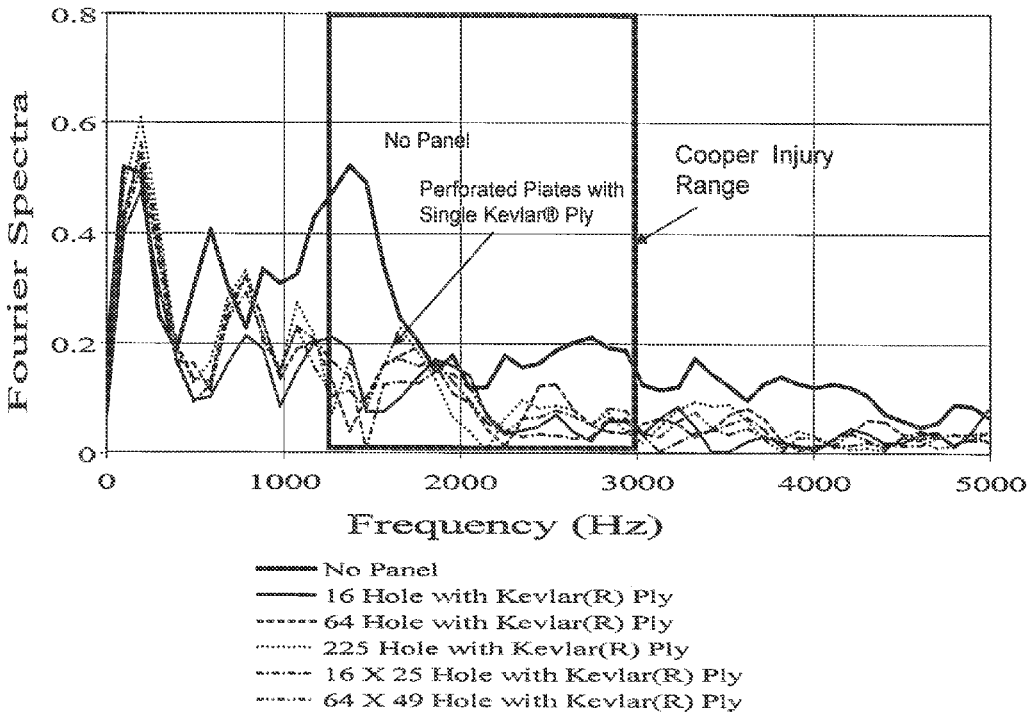
Figure 10. Fourier Spectra for Different Perforated Plate Geometries with a Single Kevlar® Ply

EXPLOSIVE BLAST FREQUENCY CONTROL SHIELD AND METHOD

CROSS-REFERENCE TO RELATED APPLICATIONS

This application claims the benefit of provisional application 61/723,896 filed Nov. 8, 2012, for the invention of an Explosive Blast Shield for Buildings by Alyssa A. Littlestone and Philip J. Dudt. This application is also a continuation-in-part of pending application Ser. No. 13/779,973 filed Feb. 28, 2013 for the invention of an Explosive Blast Shield for Buildings by Alyssa A. Littlestone and Philip J. Dudt. Ser. No. 13/779,973 claims the benefit of provisional application 61/723,896 filed Nov. 8, 2012. Both the provisional application Ser. No. 61/723,896 and the non-provisional application Ser. No. 13/779,973 are incorporated herein by reference it their entirety.

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

1. Field of the Invention

The invention relates to ordnance such as an explosive blast shield. More particularly, the invention relates to a composite panel having explosive blast frequency mitigating components. The invention is a method of mitigating specific blast frequencies that are damaging to human tissue.

2. Discussion of the Related Art

Explosive blast attack against people in open areas and in buildings continues to be a challenge in the armor arts. The primary defense against militant blast attack in open areas around buildings is a perimeter vehicle barrier such as a concrete wall. However, explosive blast generates a pressure wave that continues past a perimeter barrier. If a large explosive load is detonated, the pressure wave can travel with sufficient force to cause traumatic brain injury to people behind concrete walls and inside buildings.

Mechanisms that result in traumatic brain injury have been investigated. Suggested mechanisms include blast compression of body cavities which generate vascular pulses transmitted to the brain, skull deflection, explosively-generated, piezoelectric charge formation from loading on the bones of the skull, blast induced cerebral spinal fluid cavitation and direct transmission of pressures and accelerations sufficient to induce injury into the brain. G. J. Cooper investigated the connection between blast frequencies and effects on humans. He found, that the frequency range of 1000 and 3000 Hz is particularly damaging to lung tissue. This damaging frequency range is identified in the Drawing as the Cooper Injury Range. This work is reported in G. J. Cooper "Protection of the Lung from Blast Overpressures by Thoracic Stress Wave Decouplers", *Journal of Trauma: Injury, Infection, and Critical Care*, vol. 40, no. 3 (1996), incorporated, herein by reference. One method of reducing some of the injury to humans would be to limit exposure to blast frequencies in this range.

Investigations of potential barrier panels have identified blast wave couplers and de-couplers. Simple soft foams increased blast damage to the thorax. This was attributed to coupling the blast more effectively with the body. However when high impedance materials, such as high Young's modulus and/or density materials, were used as a facing and backed by a low impedance material such as soft foam, a blast wave decoupling was observed. Decoupling resulted in less internal blast damage to the human body.

Investigators have found that textiles exhibit differing behaviors in response to blast pressure loadings. Vests comprising some textile materials altered blast pressure loading on the thorax. One study found that a ballistic fabric vest increased blast associated injury. Another study indicated that blast pressure loading on the body could be reduced if textile fibers were pre-compressed instead of being loose.

There is a continuing need in the art of personnel protection for an effective explosive blast shield. To be fully effective in protecting human tissue, any shield must protect against the force of an explosive blast pressure wave and particularly limit exposure to the most damaging blast frequencies.

SUMMARY OF THE INVENTION

A blast shield comprises a laminar panel having at least two abutting layers. A strike surface layer comprises a woven ballistic fabric. The ballistic fabric has physical properties including:

i. a tensile strength of 45,000 lb/in$^2$ (pounds/square inch) or greater, and ii. a Young's modulus of 700,000 lb/in$^2$ (pounds/square inch) or greater.

A structural armor plate layer has traversing ports through it. Each traversing port has sufficient lateral area to allow blast deflection of the ballistic fabric into the traversing ports. Port diameters of 0.25 inches to 2 inches are sufficient to facilitate this deflection.

The ballistic fabric-faced panel has blast force dissipating properties. In addition, the panel has been found to reduce blast frequencies, particularly in the damaging 1000 to 3000 Hz range. The amount of reduction in this frequency range has been found to be sufficient to reduce human tissue injury. The panel is used in a method of shielding humans from traumatic blast including damaging blast frequencies.

BRIEF DESCRIPTION OF THE DRAWING

FIG. **4*a*-1 and FIG. 4*a*-2** are schematic drawings of the parameters defining blockage ratio for the five ballistic armor test panels reported in the Example.

FIG. **4*b*-1, FIG. 4*b*-2, FIG. 4*b*-3, FIG. 4*b*-4 and FIG. 4*b*-5** are schematic representations of each of the five ballistic armor test panels reported in the Example.

Figures 1, 2:
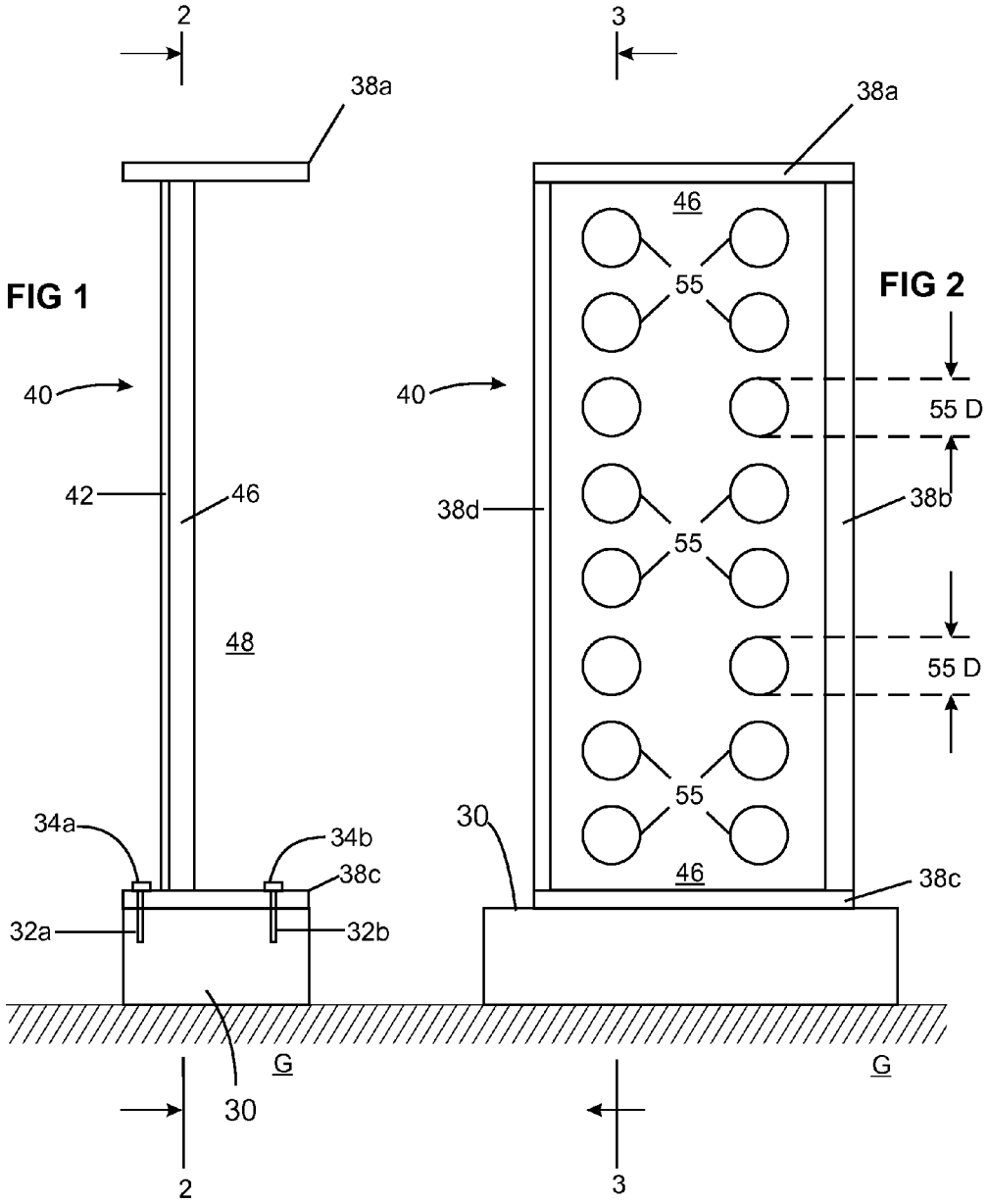
FIG. 1 is a cross-sectional side view of a shield mounted on a concrete pad.
FIG. 2 is a frontal view of the shield along section 2-2 in FIG. 1, showing ports.
Figures 1, 4A:
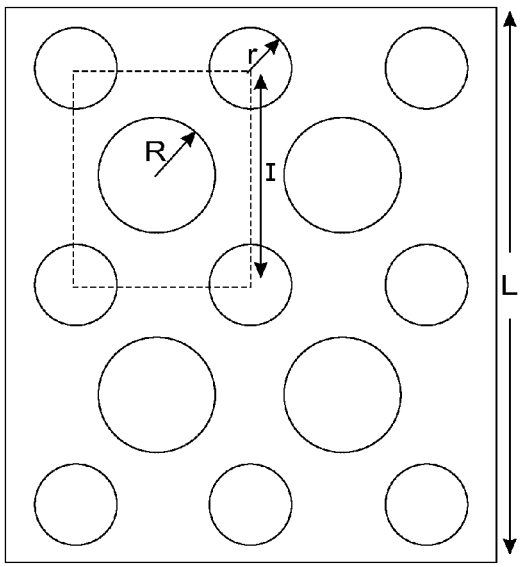
Figures 2, 4A:
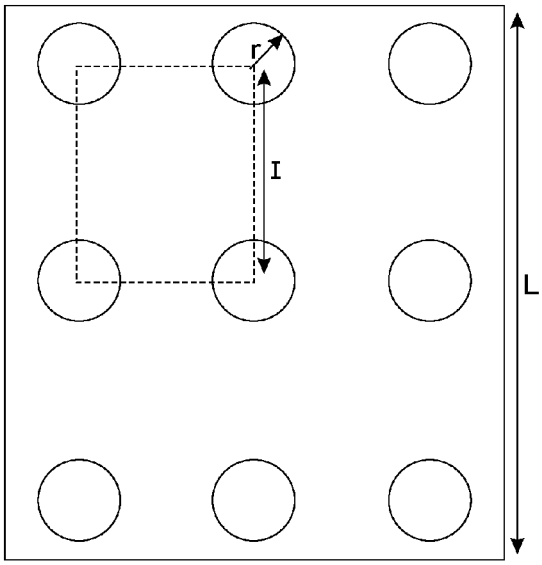
Figures 1, 4B:
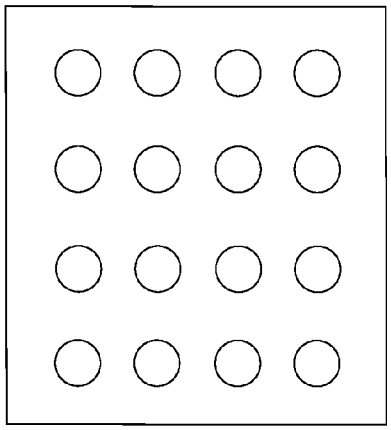
Figures 2, 4B:
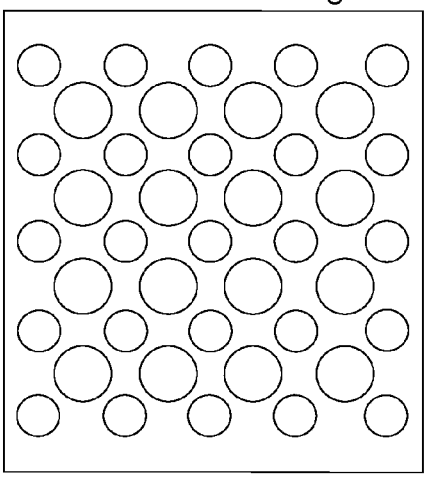
Figures 3, 4B:
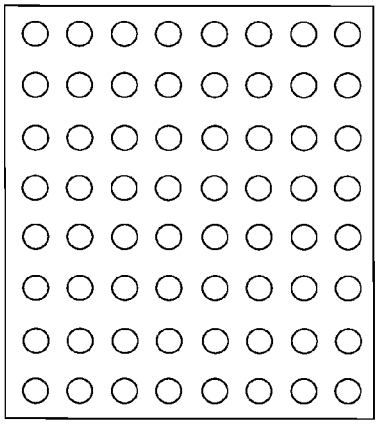

FIG. **5*a* is a graph of measured transmitted pressure data for the 16-port ballistic armor panel of FIG. 4*b*-1**.

FIG. **5*b* is a graph of impulse data calculated from the pressure data of FIG. 5*a*** for the 16-port ballistic armor Panel.

FIG. **5*c*** is a graph of the Fourier spectra frequency analysis of the pressure pulse reaching the sensor behind the 16-port ballistic armor panel.

FIG. **6*a* is a graph of measured transmitted pressure data for the 16×25-port ballistic armor panel of FIG. 4*b*-2**.

FIG. **6*b* is a graph of impulse data calculated from the pressure data of FIG. 6*a*** for the 16×25-port ballistic armor panel.

FIG. 6*c* is a graph of the Fourier spectra frequency analysis of the pressure pulse reaching the sensor behind the 16×25-port ballistic armor panel.

Figure 3:
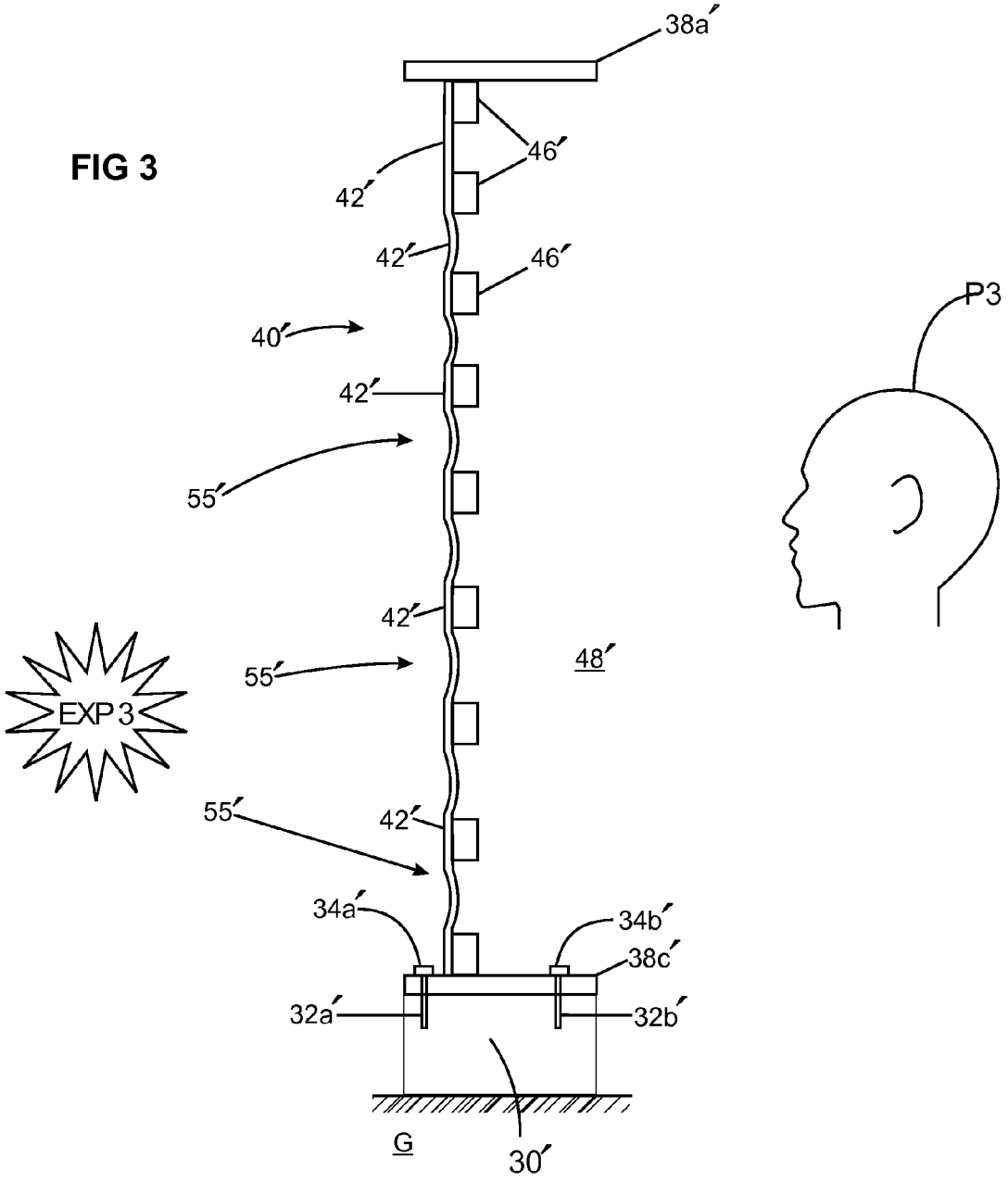
FIG. 3 is a cross-sectional side view of the shield along section 3-3 in FIG. 2, showing explosive blast deflections in the fabric strike surface layer.

FIG. 7*a* is a graph of measured transmitted pressure data for the 64-port ballistic armor panel of FIG. 4*b*-3.

FIG. 7*b* is a graph of impulse data calculated from the pressure data of FIG. 7*a* for the 16×25-port ballistic armor panel.

FIG. 7*c* is a graph of the Fourier spectra frequency analysis of the pressure pulse reaching the sensor behind the 16×25-port ballistic armor panel.

Figures 4, 4B:
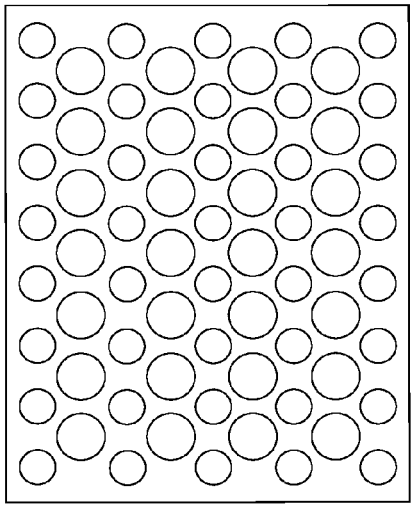

FIG. 8*a* is a graph of measured transmitted pressure data for the 64×49-port ballistic armor panel of FIG. 4*b*-4.

FIG. 8*b* is a graph of impulse data calculated from the pressure data of FIG. 8*a* for the 64×49-port ballistic armor panel.

Figures 4, 4B, 5:
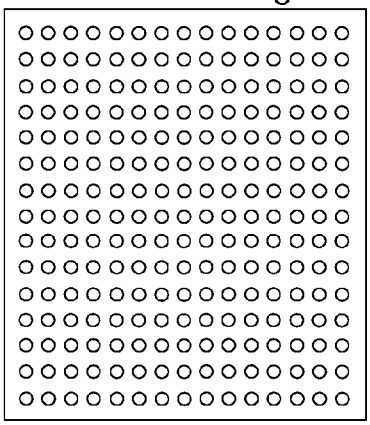

FIG. 9*a* is a graph of measured transmitted pressure data for the 225-port ballistic armor panel of FIG. 4*b*-5.

FIG. 9*b* is a seraph of impulse data calculated from the pressure data of FIG. 9*a* for the 225-port ballistic armor panel.

FIG. 10 is a graphic summary of Fourier spectra for the ported plate and single KEVLAR® ballistic fabric ply Examples.

DETAILED DESCRIPTION OF THE INVENTION

The objective of our work was a light-weight panel that limited blast pressure exposure in the damaging 1000 to 3000 Hz frequency range. A secondary objective was to limit exposure over a larger spectrum of blast frequencies. We accomplished this by combining selected textile fabrics with Ported ballistic armor plates. To be fully effective in mitigating injury to humans, a shield must mitigate the transmission of 1000 to 3000 Hz range frequencies in the pressure wave.

We used ported ballistic armor plates to support selected textile fabrics in planar orientation. We tested five ported plate configurations in combination with single and double ply facings of KEVLAR® ballistic fabric. Ballistic fabric textiles were selected for their very high strength and elongation properties under high rate loadings, typical of explosive blast. The ballistic fabric we used in our tests was DuPont™ KEVLAR® R(KM) Plus, 28 yarns/inch by 28 yarns/inch plain weave. Areal density of a single layer/ply of this ballistic fabric was 0.025 pounds/square foot. Surprisingly, none of the ballistic fabric layers in the ported plate/ballistic fabric assemblies we tested tore when exposed to direct explosive blast. This is distinguished from metallic foil layers under the same test conditions reported in co-pending application Ser. No. 13/779,973 for Explosive Blast Shield for Buildings to Alyssa A. Littlestone and Philip J. Dudt.

The invention is described with reference to the Drawing. The Drawing discloses a preferred embodiment of the invention and is not intended to limit the generally broad scope of the invention as set forth in the claims. The Drawing is schematic and is not drawn to scale.

Reference is made to FIG. 1 and FIG. 2. A generally planar blast shield 40 comprises a composite panel 42, 46. Frame members 38*a*, 38*b*, 38*c* and 38*d* hold the composite panel 42, 46 in a generally vertical, planar orientation. The composite panel 42, 46 is the assembled combination of a ballistic fabric layer 42 and a structural armor plate layer 46. Blast shield 40 is mounted on and fixedly attached to a concrete pad 30. Bolts 32*a* and 32*b* are attached to the concrete pad 30 which also includes steel reinforcement bars (not shown). Frame member 38*c* is fixedly attached to concrete pad 30 by means of the steel alloy bolts 32*a* and 32*h* and nuts 34*a* and 34*b*. Concrete pad 30 may be immobilized with steel reinforcement bars (not shown) driven into the ground G.

Alternative mountings of the blast shield are contemplated. Often the blast shield is elevated so that a congregation area 48, a building window or other place people may assemble is shielded as much as possible from direct view of a blast pressure wave. A contemplated alternative mounting includes frame member 38*c* placed atop a Jersey barrier (not shown) immobilized on the ground G. The positioning of blast shield 40 is selected to protect people, diagrammatically indicated in FIG. 3 by person P3 behind the shield 40', in the post blast congregation area 48'.

Alternative mountings of the blast shield extend utility. The blast shield may be used to shield portions of buildings. For example, the blast shield may be mounted to shield windows and doors. This can be accomplished in several ways. The blast shield may be mounted as a window or door shutter that is opened and closed as desired. The blast shield may be integrally mounted as part of a balcony so that it shields an elevated window or door from direct street view. Architectural panels comprising the shield may be attached to the building frame and positioned as an addition to an exterior surface on portions of static structures. In another mounting the panel is attached to a motor vehicle door or side panel to protect passengers.

Laminar blast shield 40 comprises adjacent layers including a ballistic fabric strike layer 42 and a structural armor plate layer 46.

Strike layer 42 comprises a single ply or multiple plies of ballistic fabric. The terms ply and layer are used interchangeably herein. It was found experimentally that a ballistic fabric layer having uniform areal density of 0.020 lb/ft$^2$ (pounds per square foot) or greater reduced the amplitude of blast frequencies in the 1000 to 3000 Hz range. A preferred ballistic fabric areal density range of 0.020 to 0.060 lb/ft' (pounds per square foot) was found to produce advantageous amplitude reductions in the critical 1000 to 3000 Hz frequency range.

Areal density is a term used in the ballistic armor arts and defined in MIL-STD-662 Department of Defense Test Method Standard $V_{50}$ *Ballistic Test for Armor*, Dec. 18, 1997, incorporated herein by reference. Areal density is a measure of the weight of armor material per unit area. It is expressed in pounds per square foot or kilograms per square meter of armor surface area. Areal density can be thought of as the amount of armor that a potential penetrator will encounter immediately on contacting the surface. The terms surface density and superficial density are also used for the same areal density measurement. This military standard also specifies the ballistic resistance test for ballistic fabrics.

Fibers used to form ballistic fabrics resistant to penetration and deformation are made of high strength, synthetic polymer that is difficult to rupture. These fiber materials have densities in the range of 0.03 lb/in$^3$ to 0.06 lb/in$^3$ (pounds per cubic inch). Suitable materials include a number of commercially available synthetic fiber materials. Such synthetic fibers include aramid polymers, polyaramid polymers (e.g. KEVLAR®), high density polyethylene polymers (e.g. SPECTRA®) and polypropylene polymers (e.g. TEGRIS®). Natural fibers can be used for ballistic fabric. All of these fibers are used in woven ballistic fabric. Reduction in blast protection is increased with the addition of layers of unidirectional ravings and plies. Also, tightly woven cloth with more crossover points causes increased mitigation of the blast wave due to internal reflections.

A preferred material of construction for the ballistic fabric include an aramid polymer, particularly para-aramid polymer, sold under the registered trade name KEVLAR® by du Pont de Nemours of Wilmington, Del. We selected KEVLAR® R(KM) Plus fabric for use in the Example based on reported physical properties. Those physical properties are reproduced in Table 1.

Ballistic fabrics having resistance to penetration and deformation are made of high strength, flexible fibers that are difficult to rupture. Suitable materials include various commercially available synthetic fibrous materials. Such synthetic fibers include aramid polymers, polyaramid polymers, polyethylene polymers and polypropylene polymers.

Para-aramid fibers are sold under the registered trademarks KEVLPR®, TECHNORA® and TWARON®. Meta-aramid fibers are sold under the registered trademarks NOMEX®, TEJINCONEX®, NESTAR® and X-FIPER®. Polypropylene fibers are sold under the registered trade mark TEGRIS®. Preferred ballistic fibers are made of super-fiber materials such as ultra-high molecular weight polyethylene sold under the registered trademarks DYNEEMA® and SPECTRA®. Natural silk fibers include silk worm silk and spider silk.

A preferred material of construction is an aramid polymer, particularly para-aramid polymer, sold under the registered trade mark KEVLAR® by du Pont de Nemours of Wilmington, Del. KEVLAR® particularly useful for ballistic properties is sold under the name KEVLAR® 129 and KEVLAR® R(KM) Plus. Another preferred ballistic fabric is made of synthetic polymer sold under the trade name DYNEEM®.

Ballistic fabrics of the invention woven from yarns of natural and synthetic yarns or filaments have physical properties including:

(i.) a tensile strength of 45,000 lb/in$^2$ or greater, (ii.) a Young's modulus of 700,000 lb/in$^2$ or greater.

These natural and synthetic based ballistic fabrics are attached to a structural armor plate layer in an amount to provide a uniform areal density of 0.020 lb/ft$^2$ to 0.060 lb/ft$^2$.

Ballistic fabrics of the invention woven from only synthetic yarns or filaments have physical properties including:

(i.) a tensile strength of 117,000 lb/in$^2$ or greater, (ii.) a Young's modulus of 700,000 lb/in$^2$ or greater. These synthetic based ballistic fabrics are attached to a structural armor plate layer in an amount to provide a uniform areal density of 0.020 lb/ft$^2$ to 0.060 lb/ft$^2$.

TABLE 1

Examples of suitable materials for the ballistic fabric

| | tensile strength, pounds/inch$^2$ | Young's modulus, pounds/inch$^2$ | density, pounds/inch$^2$ |
|---|---|---|---|
| KEVLAR ® 29 yarn | $420 \times 10^3$ | $10.2 \times 10^6$ | 0.052 |
| KEVLAR ® 49 yarn | $420 \times 10^3$ | $18.5 \times 10^6$ | 0.052 |
| KEVLAR ® R(KM) Plus yarn | $480 \times 10^3$ | $9.1 \times 10^6$ | 0.047 |
| DYNEEMA ® filament | $580 \times 10^3$ | $16.0 \times 10^6$ | 0.035 |
| Nylon ® 6 filament | $117 \times 10^3$ | $0.7 \times 10^6$ | 0.041 |
| Silk filament | $45 \times 10^3$ to $83 \times 10^3$ | $1.98 \times 10^6$ | 0.045 to 0.049 |

Tensile strength is a measure of the resistance of a material to tearing. It is the measure of the maximum tension that the material can withstand from a stretching load without tearing. Young's modulus is a measure of the stiffness of an elastic material and is particularly used to quantify the stiffness of similar materials relative to each other. Young's modulus is defined as the stress divided by the linear strain applied, along the same axis, Young's modulus is also known as the modulus of elasticity. Young's modulus is determined experimentally from the slope of a stress-strain curve constructed from tensile test measurements.

Structural armor plate layer 46 comprises a ballistic armor plate having a minimum Young's modulus of 300,000 psi and a Poisson's ratio between 0.2 and 0.35. These physical properties are achieved with a 0.25-inch to 5-inch thick layer of a ballistic armor plate of a material such as surface hardened steel, titanium armor, alumina-based ceramic, glass reinforced plastic, molded nylon and the like. Structural armor plate layer 46 has the physical characteristics of rolled homogeneous armor such as that produced to U.S. Military Specification MIL-A 12560 and the like. Examples of steel include high carbon content modified steel such as American Iron and Steel Institute (AISI) grade 4340 (Ni—Cr—Mo) steel or 4130 (Cr—Mo) steel. The steel may also be U.S. Military Specification. MIL-A 46100 or MIL-A 12560 ballistic armor. Another steel is HY-130 (Ni—Cr—Mn—Mo). In the copending application we used a naval steel plate commercially identified as HY-100(Ni, Cr, Mo, Mn). HY-100 has a Young's modulus of 30 million psi and a Poisson's ratio of 0.280. The thickness of steel plate is 0.25 inches or more, preferable 0.25 inches to 5 inches. A steel plate thickness of 0.5 inch to 4 inches has been found to be effective and practical for the intended use. In the Example we used a 0.5-inch thick 6061-T6 aluminum plate. Aluminum armor plate of various thicknesses, particularly in thicknesses of 0.25 inches to 5 inches is useful for the invention.

A suitable titanium armor is titanium alloy Ti-6Al-4V. These ballistic armors are commercially available in thicknesses of 0.25 inches to 6 inches.

Attention is drawn to FIG. 2 which shows a frontal view of the shield along section 2-2 in FIG. 1. The structural armor plate layer 46 is modified with traversing ports 5S which pass completely through the armor plate layer 46. Traversing ports 55 have diameters 55D providing sufficient lateral area to allow deformation of the ductile strike layer including highly strain rate hardening polymer layer through the structural armor plate layer. Sufficient lateral area is defined by the ballistic fabric strike surface layer material. It has been found experimentally that traversing port diameters of 0.25 inches to 2 inches are sufficient to allow deformation of the ballistic fabric strike surface into structural armor plate layer 46. In general, one ply of ballistic fabric having an areal density of 0.020 to 0.060 pounds per square foot (lb/ft$^2$) performed well in ports having diameters in the range of 0.25 to 1 inch. Two plies, i.e. layers, of ballistic fabric providing two times the area density performed well in ports having diameters in the range of 1 inch to 2 inches. That is relatively thicker ballistic fabric layers having relatively greater areal density should be combined with relatively larger diameter traversing ports to provide for deformation of the ballistic fabric layer into the ports to dissipate blast energy and filter the most damaging blast frequencies.

Relatively thinner ballistic fabric layers having relatively lesser areal density should be combined with relatively smaller diameter traversing ports. Excluded from the invention are ports that do not have sufficient diameter to allow deflection of explosively deformed ballistic fabric strike surface layer into them. For example, a plurality of small diameter perforations may provide considerable free area, but not allow extension of explosively deformed ballistic fabric strike surface layer there through. That is, smaller diameter perforations do not allow the mechanism of the invention to function. The mechanism of the invention provides for a multiplicity of ballistic fabric diaphragms to dissipate blast force by stretching and then recovering to the original laminar sheet shape. The extent of fabric stretching was defined by the force of the blast and physical characteristics of the fabric.

Ports are formed by drilling, grinding, chemical machining and the like. Precision is not necessary for the diameters 55D of the traversing ports. Depending on the anticipated threat it may be desirable to provide a number of different diameters, i.e. variation in diameters over the inventive range in the structural armor plate layer 46. Multiple diameters of different magnitude, i.e. variation in diameter 55D, provide further variation in partitioning the blast pressure wave. Radii shown in FIG. 4*a* are by definition equal to one-half the port diameter. The ports in combination with the underlying structural armor plate layer modify the blast pressure wave and dampen peak blast wave pressure impacting the target populated area 48. The ported structural armor plate layer provides additional dividing and mitigation of the explosive blast wave.

In FIG. 3, armor plate layer 46' and ports 55' correspond with armor plate layer 46 and ports 55 in FIG. 1 and FIG. 2. FIG. 3 shows a side view of the shield along section 3-3 in FIG. 2. FIG. 3 shows that the structural armor plate layer 46 is modified with traversing ports 55 which pass completely through the plate.

In addition to showing section 3-3 in FIG. 2. FIG. 3 shows post explosion blast shield 40' following the occurrence of explosive blast, schematically shown as explosive blast EXP3 directed against person P3. In FIG. 3, corresponding bolts 32*a*', 32*b*'; nuts 34*a*', 34*b*'; frame members 38*a*', 38*c*' and pad 30' remain undamaged; that is, the same as shown in FIG. 1.

Blast shield 40' is blast shield 40 following deformation by explosive blast EXP3. Post blast structural armor plate layer 46' corresponds with structural armor plate layer 46 in FIG. 1. Following explosive blast EXP3, post blast ballistic fabric layer 42' has been stretched as shown schematically in FIG. 3. The ballistic fabric remained intact in all of our tests.

Laminar blast shield 40 is assembled by stretching ballistic fabric layer 42 over the structural armor plate layer 46 and holding it in position with frame members 38*a*, 38*b*, 38*c* and 38*d*. This allows for distension of the ballistic fabric in the ports and transmission of blast forces through the fabric. As a result, transmission of the most damaging 1000 to 3000 Hz frequencies to person P3 is reduced. That is, the most damaging blast frequencies from the explosive blast. EXP3 are mitigated for any person P3 in post blast area 48'.

Theory

Inventors were inspired by their observations of explosive blast pressure measurements on diaphragm gauges. An ordinary diaphragm gauge includes a metallic pressure sensing element that elastically deforms under the effect of a pressure difference across the element. A ductile metallic disk is the pressure sensing element mounted over a circular port and exposed to an explosive blast. The ductile metallic diaphragm responds to excess pressure with a dish-shaped deflection, alternately referred to as hemispherical or concave deflection. Explosive blast pressure is read by comparison of the amount of diaphragm deflection with a set of blast pressure-calibrated diaphragms. It is possible to construct a stress-strain curve of a diaphragm material by exposing disks to sequentially increased explosive charges.

There is no simple method for calculating the rupture of a diaphragm gauge exposed to an explosive blast wave. Methods have been developed that rely on theoretical calculations corrected with empirical data. The methods are useful in reverse for estimating a useful measurement range for a diaphragm gauge and the blast wave pressure at which rupture may occur. By way of example, at explosive charge weights up to 20 pounds, the deformation of steel diaphragms is proportional to the 0.6 power of charge weight and the −1.2 power of charge stand-off distance. At explosive charge weights of 100 pounds or more, the deformation of steel diaphragms is proportional to the 0.5 power of charge weight and the 1.13 power of charge stand-off distance. Larger diameter ports allow for larger diaphragm deformations. It is also possible to measure maximum deformation before rupture for various thicknesses of thin, ductile metallic sheet material. The Examples supplemented with routine laboratory optimizations provide the user with a method of selecting ballistic fabric material for use in the invention.

Inventors found that a metallic pressure sensing element could be replaced with a sheet of ballistic fabric that dissipated considerable more explosive blast pressure than metallic pressure sensing elements previously investigated. In addition, the amplitude of certain particularly damaging frequencies in the blast frequency spectrum was reduced. Blast pressure dissipation was achieved by selecting circular port diameter and selecting ballistic fabric. The ballistic fabric distended into the ports but did not rupture to form spall during any of the tests.

Thickness of the structural armor plate and circular port diameter are selected in view of the magnitude of the anticipated explosive threat. Armor plate thicknesses at the upper end of the inventive range are paired with more ballistic fabric plies to defeat a larger magnitude explosive threat. Armor plate thicknesses at the lower end of the inventive range are paired with a single ballistic fabric ply to defeat an anticipated smaller magnitude explosive threat. Although any of the combinations of materials is effective for the intended purpose, it has been found that two plies of ballistic fabric paired well with 1-inch to 2-inch ports. A single ballistic fabric ply paired well with 0.25-inch to 1-inch ports. Smaller port diameters provide more support for thinner ballistic fabric.

This invention is shown by way of Example.

EXAMPLE

Test Set-Up and Procedure

The ballistic fabric ply we used in our tests was DuPont™ KEVLAR® R(KM) Plus, 28 yarns/inch by 28 yarns/inch plain weave. Areal density of a single ply of this ballistic fabric was 0.025 pounds/square foot.

The armor we used was 0.5-inch thick 6061-T6 aluminum plate having traversing ports with port diameters in the range of 0.4 to 2.0 inches. We faced the armor plates with a. DuPont™ KEVLAR® R(KM) Plus layer (0.025 pounds/square foot). The density of aluminum is 0.1 pounds/cubic inch. The weight of each 0.5-inch×11-inch×11-inch target armor plate assembly was about 6 pounds. Ports comprising up to 58 percent of the volume reduced the armor plate tested to about 3.5 pounds.

Five ported aluminum plates were fabricated. Three of the plates were fabricated with an array of single port diameters as follows:

Example 1. a 4×4 array of 2.0-inch diameter ports (referred to as 16 ports), (FIG. 4*h*-1), Example 3. an 8×8 array of 0.8-inch diameter ports (referred to as 64 ports), (FIG. 4*h*-3), and Example 5. a 15×15 array of 0.4-inch diameter ports (referred to as 225 ports). (FIG. 4*b*-5).

Two plates were fabricated with a combination of two different port sizes

Example 2. a. 4×4 array of 1.6-inch diameter ports and in addition a 5×5 array of 0.8-inch diameter ports (referred to as 16×25 ports), (FIG. 4*b*-2) and Example 4. an 8×8 array of 0.4-inch diameter ports and in addition a 7×7 array of 0.8-inch diameter ports (referred to as 64×49 ports), (FIG. 4*b*-4).

We used blockage ratio, described with reference to FIG. 4*a*, to characterize port area. Blockage ratio is unity minus the ratio of port surface area/total blast exposed area. The exposed area on each plate was 11-inch×11-inch. The blockage ratios are shown in Table 1 for the ported plate variations.

$$\text{Unit Blockage Ratio (Unit } BR) = 1 - \frac{nr^2 + nR^2}{I^2}$$

$$\text{Blockage Ratio } (BR) = 1 - \frac{nnr^2 + NnR^2}{L^2}$$

Wherein n=number of ports of radius r

N=number of ports of radius R r=radius of lesser size

R=radius of greater size

I=distance between centers of lesser diameter

L=unit cell exposed to blast, dimension (exposed blast area)

n=ratio of circumference to diameter of a circle, (about 3.14).

TABLE 2

Blockage Ratio for Ported Armor Plates

| Name | Number of Ports, Diameter | I | L | BR | Unit BR |
|---|---|---|---|---|---|
| 16-ports | 16 ports, 1-inch | 2.6 inch | 11 inch | 0.58 | 0.54 |
| 64-ports | 64 ports, 0.4-inch | 1.28 inch | 11 inch | 0.73 | 0.69 |
| 225-ports | 225 ports, 0.2-inch | 0.64 inch | 11 inch | 0.77 | 0.69 |
| 16 × 25-ports | 16 ports, 0.8-inch & 25 ports, 0.4-inch | 2.24 inch | 11 inch | 0.63 | 0.5 |
| 64 × 49-ports | 64 ports, 0.2-inch & 49 ports, 0.4-inch | 1.28 inch | 11 inch | 0.73 | 0.62 |

The blockage ratio (BR) varied from 0.58 to 0.77. A lower blockage ratio (BR) provided more open space for transmission of a blast wave. The blockage ratio (BR) was least for the 16-port panel with 2-inch diameter ports. The blockage ratio (BR) was greatest for the 225-port panel with 0.4-inch diameter ports.

Unit blockage ratio is based on a unit cell. It takes into account that the exposed panel size would not be constrained by the 11-inch×11-inch area and the ports would uniformly cover the larger area. Port patterns did not extend to the edge of the test panels and had a border. As seen in Table 2, the 16×25-port panel had the least unit blockage ratio of 0.5. Table 2 reports unit blockage ratios (unit BR) based on a unit cell. However in actual use, panel size would be chosen to shield a specific congregated area. That is, panels would be much larger than our 11-inch×11-inch test samples and the border area would be effectively insignificant.

The ported panels, with and without ballistic fabric, were mounted on test stands. The test stands were large frames for the ported panels. The 12-inch×12-inch ported aluminum panels were clamped into place. Exposed test area was 11-inch×11-inch with a half-inch border for attachment. The orthogonal arrangement of test panels around an explosive test charge allowed for testing four panels simultaneously. The ballistic fabric was mounted as a facing on the ported panels and held in place by the frame. The ported plate surface was spaced from the center of an explosive charge. The end detonated explosive charge produced a nominal 24 psi overpressure measured 8 inches behind the panel. This is sufficient overpressure to cause a human casualty. It was found that the explosive charges produced a distinct peak around 1500 Hz. This is the center of the 1000 to 3000 Hz injury region identified by G. J. Cooper.

The scientific literature reports that initiation of lung damage for one-time blast exposure is a function of peak pressure and duration (impulse). We have not found a definitive determination of the mechanism for traumatic brain injury in the relevant scientific literature. It is reported What blast exposure sufficient to cause brain injury may be less than for lung damage.

A pressure sensor was positioned 8 inches behind each panel, i.e. 36 inches from the explosive charge, to record the level of pressure transiting the panel. The pressure sensors used were PCB Model 137A23 Quartz ICP© pressure pencil probes. Separate pressure probes were positioned at 28-inches distance to the panel surface from charge center, and 36-inches distance behind the panel surface to measure the free field pressure. The peak pressure averaged 23 to 24 psi at the 36-inch distance. As stated, four test panels were tested simultaneously.

The frame test stand and instrument assembly was designed to capture the primary explosive blast pressure pulse. However, analysis of the data showed that a portion of the primary explosive pulse traveled around the frame test stand and was recorded on the pressure sensor. Because of this indirect route of travel, this secondary pulse was recorded with a measurable time delay behind the primary pulse.

It must be understood that the secondary pulse was an artifact of the small test panel size. A secondary pulse may not be recorded in a larger, full scale installation such as a door or window shield that provides additional cooperative shielding. However in an open field installation, such as on a Jersey barrier, secondary pulses could impact the populated area behind the panel.

Transmitted pressure was measured as follows:

(i.) without a ballistic fabric covering, and (ii.) with a single KEVLAR® ballistic fabric ply. Additional transmitted pressure measurements were made with (iii.) two KEVLAR® ballistic fabric plies.

The pressure-time profile measured was the basis for determining the Fourier spectrum. The Fourier spectrum was used to analyze the frequency content of the blast wave. We were interested in finding pressure reduction in the 1000 to 3000 Hz frequency range.

Results

The results obtained from these tests include pressure profiles from gauges placed both behind each, panel and at a distance in the free field. We also visually inspected test specimens and took photographs. From the pressure profile we calculated impulse. Fourier spectrum, and identified maximum pressure. Fourier spectrum provided a graphical view of the frequency distribution. Impulse was calculated because it has been identified as a blunt impact brain injury mechanism. In addition to peak pressure, impulse is a measurement of blast exposure.

We inspected the panels after testing. We noted that none of the KEVLAR® ballistic fabric test samples tore during blast extension into the ports. We noticed considerable pull out around the edges of the ports as the ballistic fabric sprang back after extension into the ports. We noted an imprint of the ports was left on each KEVLAR® ballistic fabric ply. The individual responses of the panels were recorded as follows.

Example 1

16-Port Panel

The 16-port ballistic armor plate was a 4×4 array of 2-inch diameter ports. The panel was tested as described above.

This panel had the lowest blockage ratio of 0.58. FIG. 5*a* shows the pressure-time profiles for the tests without a panel, a bare 16-port plate without fabric, a 16-port panel with one KEVLAR® ballistic fabric ply, and a 16-port panel with two KEVLAR® ballistic fabric plies.

The pressure pulses were digitally separated in FIG. 5*a* for easier interpretation. As seen in FIG. 5*a*, the ported plate without ballistic fabric decreased transmitted pressure from about 24 psi to about 20 psi (about 17% reduction). Addition of one KEVLAR® ballistic fabric ply reduced the pressure to about 2-3 psi (about 90% reduction). Two plies of KEVLAR® ballistic fabric reduced the pressure to about 1 psi (96% reduction). This was significant pressure reduction for the relatively small added weight of a second ply.

FIG. 5*b* shows that transmitted impulse was reduced about 85% by KEVLAR® ballistic fabric plies. The transmitted impulse values were recorded in real time from the detonation of the charge until arrival of the pulse on the sensor about 1 millisecond later.

The Fourier spectrum for the recorded pressure pulse is shown in FIG. 5*c*. The 1000 to 3000 Hz injury region is identified as the cooper Injury Range. The blast frequency content in the 1000 to 3000 Hz range was decreased with a single ply of KEVLAR® ballistic fabric. A large reduction in frequency content began at about 1000 Hz. There was more reduction in the 1000 to 3000 Hz range with addition of a second KEVLAR® ballistic fabric ply. Two KEVLAR® ballistic fabric plies also reduced the transmitted pressure at frequencies above 3000 Hz.

The Fourier spectrum for the panel with a single KEVLAR® ply for each Example is reported in FIG. 10.

Example 2

16×25-Port Panel

The panel was a 4×4 array of ports with 1.6 inch diameters. An additional 25 ports of 0.8-inch diameter were added between the larger ports. The panel was tested as described.

The 0.50 unit blockage ratio of this panel was the lowest of all the panels tested. However, within the 11-inch×11-inch exposed specimen area, the blockage ratio was 0.54, slightly greater than the 16-port panel.

Transmitted pressures for the 16×25-port panel are shown in FIG. 6*a*. Results for the tests without a panel, a bare 16×25-port plate without fabric, a 16×25-port panel with one KEVLAR® ballistic fabric ply, and a 16×25-port panel with two KEVLAR® ballistic fabric plies are shown. The pressure drop from the ported plate alone was from about 24 to 20 psi, the same as for the 16-port panel. One KEVLAR® ballistic fabric ply reduced pressure from about 24 psi to about 2.5 psi, about 90% reduction. A second KEVLAR® ballistic fabric ply provided additional, though lesser, reduction.

FIG. 6*b* shows the reduction in impulse.

FIG. 6*c* shows that the Fourier spectrum was reduced in the injurious frequencies of 1000 to 3000 Hz identified as the Cooper Injury Range. There was a notable drop around 1500 Hz, especially for a single KEVLAR® ballistic fabric ply. There was a large reduction in amplitude in the damaging 1000 to 3000 Hz frequency range and also a reduction of higher frequencies.

The Fourier spectrum for the panel with a single KEVLAR® ply is reported in FIG. 10 for each Example.

Example 3

64-Port Panel

The 64-port plate was an 8×8 array of 0.8-inch diameter ports. The panel was tested as described above.

Unit blockage ratio was 0.69. Panel blockage ratio was 0.73. This 64-port panel without a KEVLAR® ballistic fabric ply decreased the transmitted pressure to about 18 psi. FIG. 7*a*. This is a pressure drop to 25%. Adding a single KEVLAR® ballistic fabric ply resulted in a drop to nominally 2 psi in transmitted pressure, a 90% reduction. Adding a second ply provided lesser additional reduction in pressure.

The drop in transmitted impulse was also on the order of 90 percent, FIG. 7*b*.

FIG. 7*b* shows the reduction in impulse.

Fourier spectrum is shown in FIG. 7*c* for each case. There was a major drop in the critical 1000 to 3000 Hz frequency range. The 1000 to 3000 Hz injury region is identified as the Cooper Injury Range.

The Fourier spectrum for the panel of each Example with a single KEVLAR® ply is reported in FIG. 10.

Example 4

64×49-Port Panel

The 64×49-port plate was an 8×8 array of 0.4-inch diameter ports and a 7×7 array of larger 0.8-inch diameter ports. The unit blockage ratio for this panel was 0.62. Panel blockage ratio was 0.73. The panel was tested as described.

Test results for the pressure-time characteristics are shown in FIG. 8*a*. A second KEVLAR® ballistic fabric ply was not evaluated. The pressure drop with the ported plate alone was about 17 psi, a 30% reduction in pressure.

The pressure transmitted through the ported plate with a single layer of ballistic fabric was quite low. The impulse was also low as reported FIG. 8*b*. The peak diffracted pressure with a single KEVLAR® ballistic fabric ply was close to 10 psi.

The Fourier spectrum for the panel of each Example with a single KEVLAR® ply is reported in FIG. 10.

Example 5

225-Port Panel

The 225-port plate was a 15×15 array of 0.4-inch diameter ports. This panel had the highest blockage ratio of 0.77. Unit blockage ratio was 0.69. The panel was tested as described.

The transmitted pressure was about 19 psi, FIG. 9*a*. However, the 64×49-port panel with a blockage ratio of 0.73 had a lower transmitted value of 17 psi. Addition of a single KEVLAR® ballistic fabric ply was effective in limiting transmitted pressure and impulse as seen in FIGS. 9*a* and 9*b*. Incident pressure was 24 psi and the transmitted pressure after contact with the panel was about 4 psi, an 83% reduction.

The Fourier spectrum for the panel of each Example with a single KEVLAR® ply is reported in FIG. 10.

Fourier Spectra Results

A comparison of all the Fourier spectra for the ported plates with a single KEVLAR® ballistic fabric ply is shown in FIG. 10. Overall, the KEVLAR® ballistic fabrics and the different ported plate panels produced a significant drop in the 1000 to 3000 Hz frequency range associated with lung injury. The 1000 to 3000 Hz injury region is identified as the Cooper Injury Range. We did not consider increased areal density with addition of a second KEVLAR® layer significant for practical applications. Frequencies over 3000 Hz were also reduced.

Summary of Results

Ported plates with blockage ratios between 0.58 and 0.77 were fabricated. We found that the transmitted blast pressure could be reduced by as much as 30 percent. A single ply of ballistic fabric reduced transmitted pressure by up to 90 percent of the initial pulse magnitude. There was also an equivalent reduction in transmitted impulse. When ballistic fabric was added, reductions were substantially independent of blockage ratio. Lowering blockage ratio reduces the weight of the ballistic armor panel. A single ply of KEVLAR® ballistic fabric resulted in a major reduction in blast frequency amplitude in the critical 1000 to 3000 Hz range as well as a reduction in higher frequencies.

The foregoing discussion discloses and describes embodiments of the invention by way of example. One skilled in the art will readily recognize from this discussion, that various changes, modifications and variations can be made therein without departing from the spirit and scope of the invention as defined in the following claims.

What is claimed is:

1. A blast frequency control shield comprising a panel including abutting layers consisting essentially of:

(a.) a strike surface layer comprising a ballistic fabric layer having:

(i.) a tensile strength of 45,000 lb/in$^2$ or greater, (ii.) a Young's modulus of 700,000 lb/in$^2$ or greater; and (b.) a structural armor plate layer having traversing ports uniformly distributed over the structural armor plate layer, each traversing port having sufficient lateral area to allow deformation of the ballistic fabric layer into the ports, and wherein:

(c.) the panel is characterized in a blockage ratio of 0.58 to 0.77, the blockage ratio defined by the number 1.00 minus a quotient of total traversing port lateral area divided by panel fabric-faced area.

2. The blast frequency control shield of claim 1, wherein in the panel, the ballistic fabric has a tensile strength of 420,000 lb/in$^2$ or greater.

3. The blast frequency control shield of claim 1, wherein in the panel, the ballistic fabric has a uniform areal density of 0.020 lb/ft$^2$ or greater.

4. The blast frequency control shield of claim 1, wherein in the panel, the ballistic fabric has a uniform areal density of 0.020 lb/ft$^2$ to 0.060 lb/ft$^2$.

5. The blast frequency control shield of claim 1, wherein in the structural armor plate layer, the traversing ports have diameters in the range of 0.25 to 2 inches.

6. The blast frequency control shield of claim 1, wherein in the structural armor plate layer, the traversing ports have a uniform diameter selected in the range of 0.25 to 2 inches.

7. The blast frequency control shield of claim 1, wherein in the structural armor plate layer, the traversing ports have multiple diameters selected in the range of 0.25 to 2 inches.

8. The blast frequency control shield of claim 1, wherein the structural armor plate layer is 0.25 to 5 inches thick.

9. The blast frequency control shield of claim 1, wherein the structural armor plate layer is 1 to 5 inches thick and the traversing ports are 0.25 to 2 inches in diameter.

10. A blast frequency control shield comprising a laminar panel having abutting layers consisting essentially of:

(a.) a strike layer including a ballistic fabric layer having:

(i.) a tensile strength of 420,000 lb/in$^2$ or greater, (ii.) a Young's modulus of 9,100,000 lb/in$^2$ or greater, and (iii.) a uniform areal density of 0.020 lb/ft$^2$ to 0.060 lb/ft$^2$; and (b.) a structural armor plate layer having uniformly distributed traversing ports, the traversing ports 0.25 to 2 inches in diameter, and wherein:

(c.) the laminar panel has a blockage ratio of 0.58 to 0.77, the blockage ratio defined by the number 1.00 minus a quotient of total traversing port lateral area divided by panel fabric-faced area.

11. The blast frequency control shield of claim 10, wherein in the structural armor plate layer, the traversing ports have diameters in the range of 0.25 to 2 inches.

12. The blast frequency control shield of claim 10, wherein in the structural armor plate layer, the traversing ports have a uniform diameter selected in the range of 0.25 to 2 inches.

13. The blast frequency control shield of claim 10, wherein in the structural armor plate layer, the traversing ports have multiple diameters selected in the range of 0.25 to 2 inches.

14. The blast frequency control shield of claim 10, wherein the structural armor plate layer is 0.25 to 5 inches thick.

15. The blast frequency control shield of claim 10, wherein the structural armor plate layer is 1 to 5 inches thick and the traversing ports are 0.25 to 2 inches in diameter.

16. A method of protecting humans from explosive blast frequencies in the range of 1000 to 3000 Hz comprising shielding the humans with a laminar panel including abutting layers consisting essentially of:

(a.) a ductile strike layer including a ballistic fabric layer having:

(i.) a tensile strength of 45,000 lb/in$^2$ or greater, (ii.) a Young's modulus of 700,000 lb/in$^2$ or greater, (iii.) a uniform areal density of 0.020 to 0.060 lb/ft$^2$; and (b.) a structural armor plate layer having uniformly distributed traversing ports, the traversing ports 0.25 to 2 inches in diameter, and wherein:

(c.) the laminar panel has a blockage ratio of 0.58 to 0.77, the blockage ratio defined by the number 1.00 minus a quotient of total traversing port lateral area divided by panel fabric-faced area.

* * * * *